United States Patent [19]

Cavaca

[11] Patent Number: 4,802,358

[45] Date of Patent: Feb. 7, 1989

[54] VEHICLE REPAIR APPARATUS

[75] Inventor: Roger Cavaca, Portsmouth, R.I.

[73] Assignee: Andrew A. Bucci, Johnston, R.I. ; a part interest

[21] Appl. No.: 73,530

[22] Filed: Jul. 10, 1987

[51] Int. Cl.[4] ..... B21D 1/12

[52] U.S. Cl. ..... 72/308; 72/705

[58] Field of Search ..... 72/308, 705

[56] References Cited

U.S. PATENT DOCUMENTS

| | | | |
|---|---|---|---|
| 3,501,938 | 3/1970 | Sprague | 72/705 |
| 3,817,074 | 6/1974 | Crosthwaite | 72/705 |
| 3,999,419 | 12/1976 | Larson et al. | 72/705 |

*Primary Examiner*—Lowell A. Larson

*Attorney, Agent, or Firm*—Salter & Michaelson

[57] ABSTRACT

Apparatus for use in the repair of vehicles, including a horizontal beam that extends beneath the vehicle and having an anchor joined thereto for securing the beam to the underside of the vehicle for locating the horizontal beam in a fixed position relative to the vehicle, a vertical beam being fixed to the horizontal beam and having a bracket mounted in adjustable position thereon, a pulling chain extending through the bracket and having an end that is attached to the part of the vehicle to be repaired, the other end thereof being fixed to the vertical beam, an hydraulic cylinder being located for pivotal movement in the bracket and having a piston that is secured to the chain, and a control device that is operative to cause outward movement of the piston which exerts a pulling action on the chain, wherein the part to be repaired is pulled outwardly for the straightening thereof.

10 Claims, 2 Drawing Sheets

VEHICLE REPAIR APPARATUS

BACKGROUND OF THE INVENTION

The present invention relates to apparatus for use in the repair of vehicles, and more particularly relates to apparatus that is conveniently movable from one location to another and that includes an hydraulic pulling mechanism that enables a dent or the like to be easily and quickly pulled to a position for finished repair.

It has been the usual procedure in the repair of vehicles that have suffered damage in collisions to pull out the dents and other parts of the vehicle that have been subjected to impact to a position for finished repair. Various kinds of apparatus for this purpose have been utilized heretofore, some of this apparatus being air operated. It has been found that air-operated dent pullers were difficult to control and did not enable the operator to obtain an effective result. Hydraulic-operated dent pullers have also been developed and provide a more effective tool for accomplishing their purposes. Examples of such devices which represents the best prior art of which applicant is aware are in U.S. patents to FERGUSON et al, U.S. Pat. No. 2,979,102; KUHN, U.S. Pat. No. 4,189,934; JARMIN et al, U.S. Pat. No. 4,475,716; CELETTE, U.S. Pat. No. 4,501,136; and DOUGHTY, U.S. Pat. No. 4,574,613.

The patent to FERGUSON et al, U.S. Pat. No. 2,979,102, discloses the use of a portable straightening tool that is provided with a horizontal beam that is movable beneath a vehicle to be repaired. Although the FERGUSON et al patent does include some form of a power cylinder and chain for effecting a pulling action in the straightening of dents in vehicles, the FERGUSON et al patent does not provide for sufficient control of the power cylinder to enable the chain to be pulled in a manner that provides for the incremental movement of the part of the vehicle to be repaired to the restored position thereof. The patent to FERGUSON et al further does not utilize a bracket assembly through which a pulling chain extends for use in exerting the pulling action for restoring the damaged part to a position for finishing. The patents to KUHN, U.S. Pat. No. 4,189,934, and DOGHTY, U.S. Pat. No. 4,574,613, illustrate some form of a bracket assembly as used in dent pullers but do not provide for the portable movement of a horizontal beam beneath the vehicle to be repaired. Thus, neither FERGUSON, KUHN nor DOUGHTY show the combination of elements of the subject invention that provide for the convenient and efficient operation thereof. The other patents referred to above, that is, the patents to JARMIN et al, U.S. Pat. No. 4,475,716 and CELETTE, U.S. Pat. No. 4,501,136, show other forms of straightening devices for vehicles that are only of general interest.

Because of the deficiencies of the prior art devices in providing a convenient portable apparatus that is simple to use and effective in operation for the repair of damaged vehicles, the subject invention has been developed; and as will be discussed hereinafter, the present invention provides a relatively inexpensive apparatus that is portable in use and that is simple and effective in the operation thereof.

SUMMARY OF THE INVENTION

The present invention relates to apparatus for use in the repair of the body of a vehicle and includes an elongated horizontal beam that is selectively placed beneath the vehicle on which a body repair is required. The apparatus of the subject invention includes an anchor device that is located on the horizontal beam of the horizontal beam for anchoring the outermost end to the underside of the vehicle in a selected position of use. A vertical beam is fixed to the horizontal beam adjacent to the end thereof that is opposite to the end on which the anchor device is located, and a bracket is mounted on the vertical beam and disposed in vertial, adjustable relation thereon. A pulling chain extends through the bracket, one end of the pulling chain being interconnected to the vertical beam in fixed relation, and the otehr end being free and extending outwardly of the bracket for being attached to a selected portion of said vehicle that is to be repaired. In order to exert a pulling action on said chain, a main hydraulic cylinder is provided and is pivotally mounted in said bracket and includes a piston that extends outwardly therefrom for engagement with the chain in fixed relation. Operatively communicating with the hydraulic cylinder is a portable control member that includes a manually-operated element for controlling the operation of the hydraulic cylinder and the piston therein to incrementally force the piston outwardly of the cylinder, thereby exerting an incremental pulling action on the chain for straightening the part of the vehicle to be repaired.

Accordingly, it is an object of the present invention to provide a simple device that is portable and that is easily placed in position for pulling dents out of fenders and for moving bumpers and the like from a bent to a straight position and for generally providing a means for quickly and efficiently straightening portions of vehicles that have been subjected to impact.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
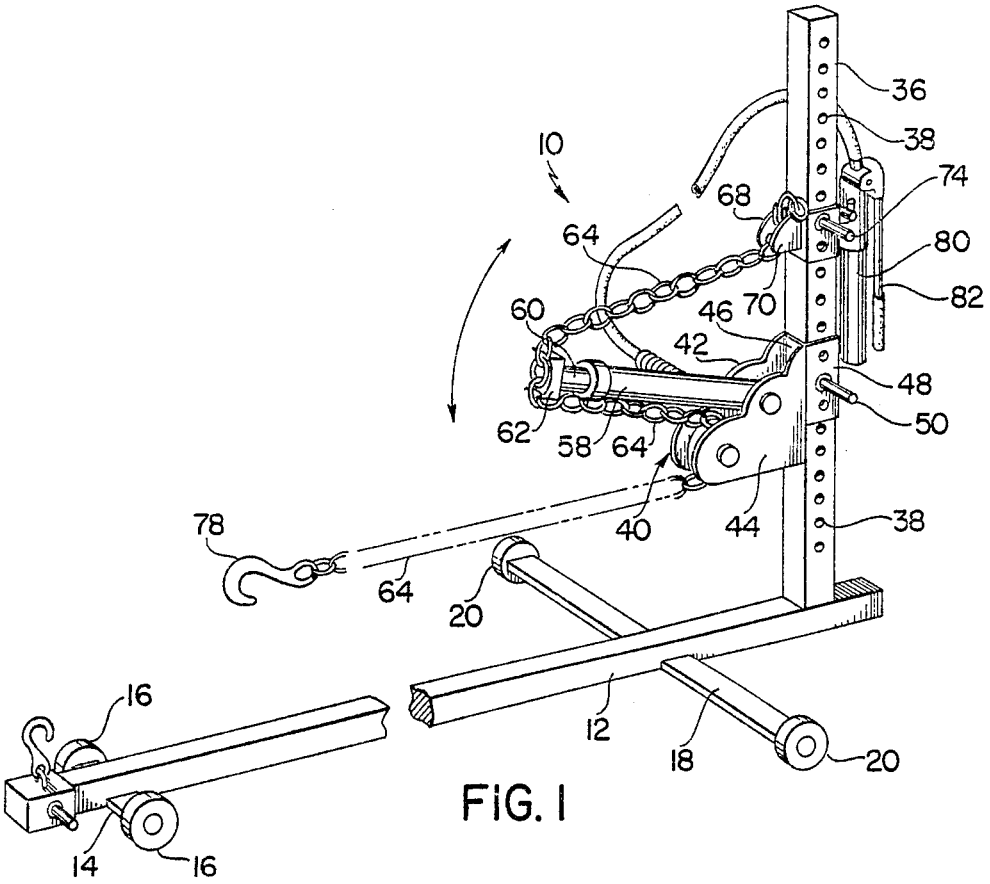
FIG. 1 is a perspective view of the apparatus embodied in the subject invention that is utilized in the repair of vehicles.

Referring now to the drawings, and particularly to FIG. 1, the vehicle repair apparatus embodied in the subject invention is illustrated and is generally indicated at 10. The repair apparatus 10 includes an elongated horizontal beam 12, adjacent to the outermost end of which a shortened crossmember 14 is secured. Mounted on the outermost ends of the crossmember 14 are small rollers 16 that cooperate with rollers on the opposite end of the horizontal beam 12, as will be described, to enable the apparatus 10 to be easily and quickly moved to a selected position of use. Also fixed to the horizontal beam 12 and spaced from the shortened crossmember 14 is a crossmember 18 on the outermost ends of which are mounted small rollers 20. It is seen that the horizontal beam 12 is located closely adjacent to the surface on which the rollers 16 and 20 are positioned, and thus the beam 12 is conveniently movable beneath the underside of a vehicle to be repaired for placing the repair apparatus in the proper position of use.

Figure 2:
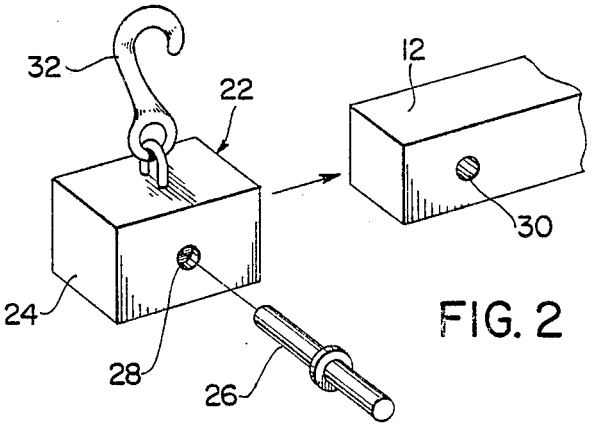
FIG. 2 is a perspective exploded view of one form of an anchoring device that is attached to the outermost end of a horizontal beam that is illustrated in FIG. 1.

Also mounted on the outermost end of the horizontal beam 12 is an anchoring device generally indicated at 22 which, as shown in FIG. 2, includes a sleeve 24 that is slidably received on the adjacent end of the beam 12. The sleeve 24 is fixed in place on the beam 12 by a pin 26 that is received in an opening 28 formed in the sleeve 24 and in a corresponding opening 30 that is located adjacent to the outermost end of the horizontal beam 12. Mounted on the topmost surface of the sleeve 24 is a hook 32 of selected shape, configuration and size. The hook 32 is designed to be secured to the underside of the frame of the vehicle to be repaired so that when a pulling action is exerted on the portion of the vehicle to be repaired, the apparatus is firmly secured to the vehicle; and thus, the weight of the vehicle is utilized to anchor the repair apparatus to enable the pulling action to be effected as required. On occasion, the shape and configuration of the anchoring hook as secured to the device 22 must be different in size, shape and configuration for attachment to the frame of the vehicle being repaired; and it is for this purpose that the sleeve 24 is removable from the mounted position on the end of the horizontal beam 12 and replaced by a similar sleeve having a hook of required size, shape and configuration.

Figure 3:
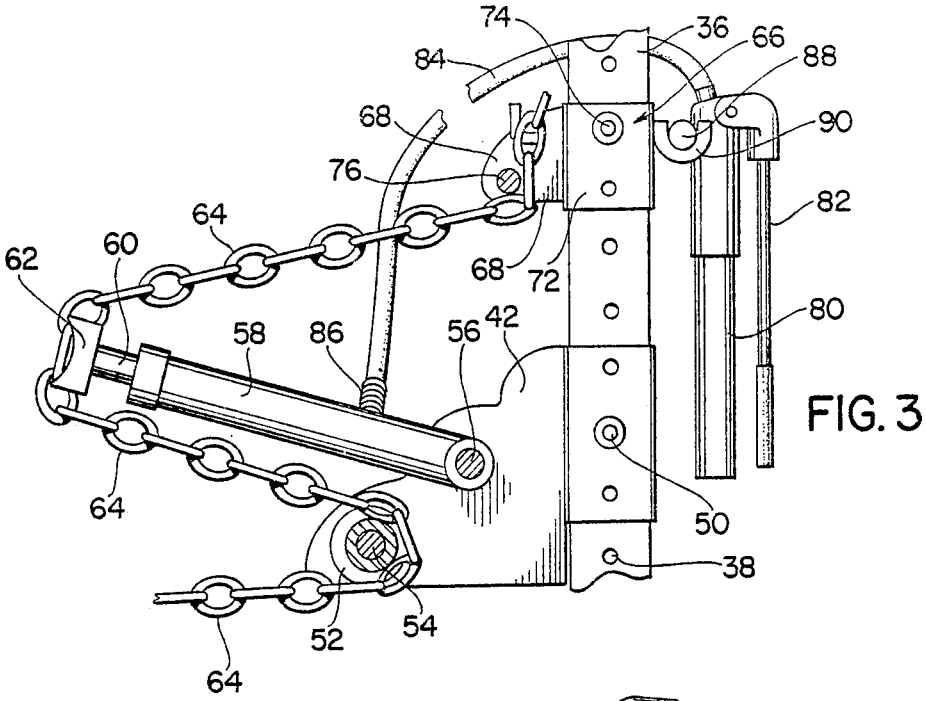
FIG. 3 is an enlarged view with parts shown in section of the actuating mechanism of the subject invention, wherein an hydraulic cylinder thereof is illustrated in its inoperative position.
Figure 4:
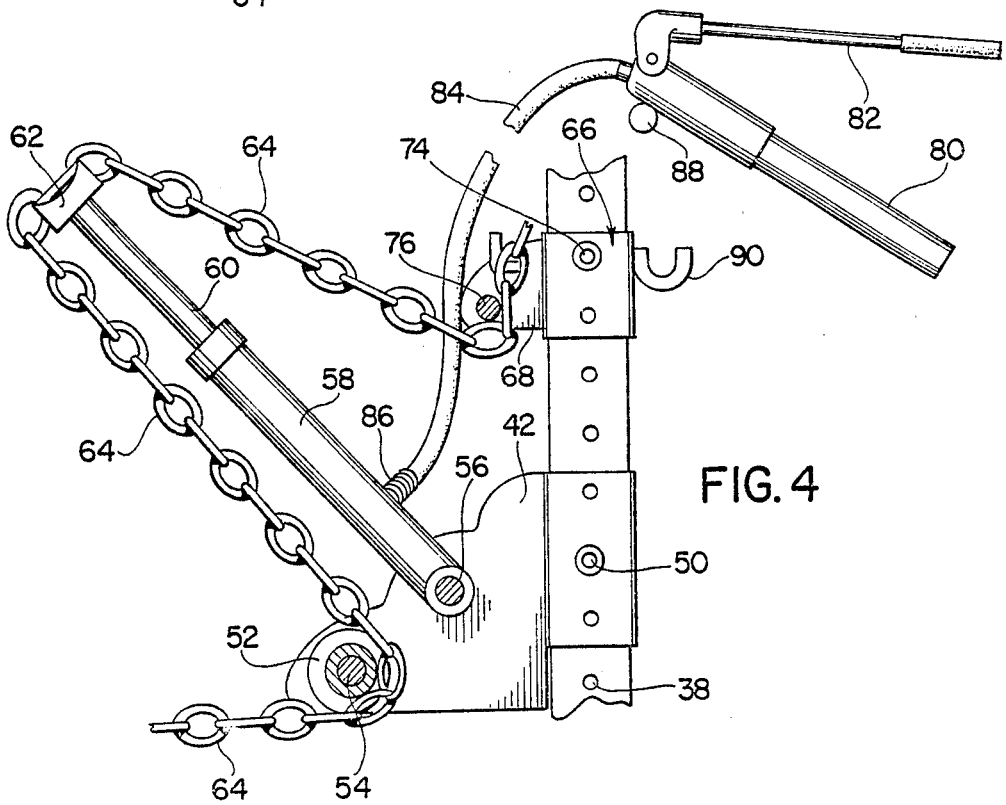
FIG. 4 is a view similar to FIG. 3 showing the hydraulic cylinder in the operative position thereof, wherein a pulling force is being exerted on the pulling chain of the apparatus.

Referring again to FIG. 1, and also referring to FIGS. 3 and 4, it is seen that a vertical beam 36 is mounted on the horizontal beam 12 adjacent to the end that is opposite to the anchoring end thereof. Formed in the vertical beam 36 and extending therethrough are a plurality of vertically spaced holes 38. Mounted in a selected position on the vertical beam 36 is a bracket generally indicated at 40 that includes spaced plates 42 and 44 that are joined to a rear plate 46 formed as part of an integral sleeve 48. The sleeve 48 is normally square in cross-sectional configuration, the size of which corresponds to the configuration of the vertical beam 36. As shown in FIGS. 1, 3 and 4, the sleeve 48 is slidably received on the vertical beam 36 and is held in place thereon by a pin 50 that extends through appropriate openings 38 formed in the sides of the sleeve 48 and through an aligned opening 38 located in the beam 36. Thus, the bracket 40 is adjustably mounted in a selected position of use on the vertical beam 36, and is so disposed that in the operation of the apparatus a straight-line force is exerted on the dent or the part of the vehicle that is being repaired.

As illustrated more clearly in FIGS. 3 and 4, a pulley 52 is located between the plates 42 and 44 of the bracket 40 and is rotatably mounted on a stub shaft 54 that is fixed in the spaced opposed plates 42 and 44. Mounted for pivotal movement between the plates 42 and 44 of the bracket 40 by a pin 56 is a main hydraulic cylinder 58 in which a piston 60 is located for movement with respect thereto. Secured to the outermost end of the piston 60 is a retainer member 62, the purpose fo which is to fix a chain 64 thereto, as will be described in detail hereinafter.

Also mounted in selected vertical position on the vertical beam 36 is an upper bracket 66 that includes shortened spaced apart plates 68 and 70 and a sleeve 72 joined to the plates 68 and 70 that has a square cross-sectional configuration that provides for mounting of the bracket 66 in a selected position on the vertical beam 36. A pin 74 extends through appropriate openings formed in the opposite sidewalls of the sleeve 72 and through an aligned opening 38 in the vertical beam 36 for locating the upper bracket 66 in place. Fixed between the spaced plates 68 and 70 is a crosspin 76 that is designed to confine an end of the chain 64 in a fixed position as will also be more completely described hereinafter.

The chain 64 which is utilized as the means for exerting a pulling action on a part of the vehicle that is to be repaired is a conventional link chain that extends outwardly of the bracket 40 terminating in a hook 78 that is attachable to the part of the vehicle to be pulled outwardly for repair. The hook 78 can also be replaced with another form of pulling element that can be conveniently attached to the part of the vehicle to be repaired. The chain 64, as illustrated in FIGS. 3 and 4, extends around the pulley 52 of the bracket 40 and over the element 62 for securement thereto. The element 62 has raised edges which extend through the links of the chain which insures that the chain will be fixed to the piston during an operating movement thereof. The remaining portion of the chain 64 extends between the plates 68 and 70 of the upper bracket 66 behind the crosspin 76 to further confine the chains, and is allowed to hang loosely from the top of the bracket 66 as illustrated in FIG. 1. It is seen that a pulling action is exerted on the chain 64 and the hook 78 attached to the outer end thereof by forcing the piston 60 as located in the main cylinder 58 outwardly therefrom. Since the chain 64 is confined by the bracket 66 qand is fixed to the outer end of the piston 60, the main cylinder 58 is forced to move in a pivotal direction as shown in FIG. 4, thereby pulling the hook end of the chain 64 therewith as the piston moves outwardly of the main cylinder 58.

In order to actuate the piston 60 within the main cylinder 58 and to produce the pivotal action of the main cylinder, an operating mechanism is provided and, as also shown in FIGS. 3 and 4, includes an hydraulic operating cylinder 80 on which an actuating handle 82 is pivotally mounted. Connected to the operating cylinder 80 is an hydraulic hose 84 that is further connected to the main cylinder 58 by a coupling 86. Fixed to the operating cylinder 80 adjacent to the hose 84 is a small crossbar 88, and in the position of nonuse of the operating cylinder 80 is placed in spaced hangers 90 that are secured to the vertical beam 36, as illustrated in FIGS. 1 and 3. In the use of the apparatus, the operator removes the operating cylinder 80 from the hangers 90 as shown in FIG. 4 and carries it to a convenient location for observing the pulling action on the part of the vehicle to be repaired. The operator then pivotally moves the operating handle 82 to force hydraulic fluid into the main cylinder 58 for forcing the piston 80 outwarldy to exert an incremental pulling action on the chain 64.

In operation, the operator of the apparatus locates the horizontal beam 12 beneath a convenient part of the vehicle to be repaired and fixes the horizontal beam 12 to the chassis of the vehicle frame. The hook 78 that is attached to the outermost or free end of the chain 64 is then secured to the part of the vehicle that is to be pulled from an impacted position to a restored position for repair. Thereafter, the operator removes the operating cylinder 80 from its cradled position on the vertical beam 36; and, since the hose 84 is flexible, the operator can easily move adjacent to the part of the vehicle that is to be repaired. The operator incrementally pivots the operating handle 82 of the operating cylinder 80 as required, and hydraulic fluid is forced through the hose 84 and into the main cylinder 58. The piston 60 is then incrementally urged outwardly, and the cylinder 58 pivots upwardly as illustrated in FIG. 4. Since the chain 64 is fixed to the piston 60, an outwardly directed force is exerted on the chain which forces the part to be repaired in an outward direction until the part is moved to the restored position thereof that satisfies the operator of the apparatus. After the part has been moved to the restored position to the satisfaction of the operator, the oepratore then deactivates the operating cylinder by moving the operating handle 82 to the inoperative position, which enables the piston 60 to return within the cylinder 58. The hook 78 as mounted on the chain 64 is then removed from the restored part to complete the operation.

It is seen that the repair apparatus as disclosed herein is simple to operate and enables the operator of the apparatus to have convenient visual access to the part being repaired or straightened. Thus, the operator can pivotally move the operating handle 82 in increments to exert an incremental pullling action on the chain 64 for gradually moving the part to be restored outwardly until the part is fully restored to a position, whereby the part can be finished in a conventional manner.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. Apparatus for use in the repair of a vehicle, comprising an elongated horizontal beam on which rollers are mounted to provide for selected placement of said horizontal beam beneath the vehicle on which a repair is required, means located adjacent to an outermost end of said beam for anchoring said outermost end to the underside of said vehicle for securing said horizontal beam in the selected position of use, a vertical beam fixed to said horizontal beam adjacent to the end thereof that is opposite to the outermost end on which said anchoring means is located, a bracket mounted on said vertical beam in vertical adjustable relation, a pulling chain extending through said bracket and having a first end that is interconnected to said vertical beam in fixed relation, the other end of said chain being free and extending outwarldy of said bracket for being located in place on a selected portion of said vehicle that has been damaged and that is to be repaired, a main hydraulic cylinder, one end of which is mounted for pivotal movement in said bracket, a piston extending outwardly of said cylinder for axial relative movement with respect thereto, the outermost end of said piston being fixed to said chain between the ends thereof, and said piston being pivotally movable with said cylinder relative to said bracket simultaneously with the axial movement of said piston with respect to said cylinder, and portable control means for actuating said piston in said hydraulic cylinder to incrementally force said piston carried thereby are pivotally movable upwardly relative to said bracket, the outward and pivotal movement of said piston exerting an incremental pulling action on the free end of said chain for restoring the damaged portion of said vehicle on which the free end of said chain has been located to a position for finishing the repair thereof.

2. Apparatus as claimed in claim 1, said bracket including a pulley that is mounted therein and that receives said pulling chain therearound to aid in guiding said pulling chain during the repairing operation.

3. Apparatus as claimed in claim 2, said bracket including spaced opposed plates between which said pulley is located, the pivot axis of said hydraulic cylinder being spaced above the axis of said pulley wherein said hydraulic cylinder is mounted between said plates for free pivotal movement above said pulley.

4. Apparatus as claimed in claim 3, said bracket including a sleeve that is slidably mounted on said vertical beam, and means for locating said sleeve in a selected vertical position on said vertical beam for positioning said bracket in a corresponding vertical position thereon.

5. Apparatus as claimed in claim 4, a second bracket mounted for adjustable movement on said vertical beam and receiving said first end of said chain in fixed position thereon.

6. Apparatus as claimed in claim 1, said piston control means including a portable hydraulic actuator that includes a cylinder that communicates with the main hydraulic cylinder, and a handle that is pivotally secured to said portable hydraulic actuator and that is operable to force hydraulic fluid into said main cylinder for urging said piston in an outward operating movement during the repair operation.

7. Apparatus as claimed in claim 6, a flexible hydraulic hose interconnecting said piston actuating control means and said main hydraulic cylinder to provide for carrying of the piston actuating control means by the operator of the apparatus to a selected advantageous position for actuation during the repair operation.

8. Apparatus as claimed in claim 7, holding means fixed to said vertical beam, and means secured to the cylinder of said hydraulic actuator for storing said piston control means in a position of nonuse.

9. Apparatus as claimed in claim 1, said anchoring means including an anchor sleeve that is removably mounted on the outermost end of said horizontal beam, and a hook means of selected size and length being secured to said anchor sleeve for attachment to the underside of said vehicle.

10. Apparatus as claimed in claim 1, a first cross member secured to said horizontal beam adjacent to the outermost end thereof and having a first set of rollers mounted thereon, a second cross member secured to said horizontal beam in spaced relation with respect to said first cross member and having a second set of rollers mounted thereof, said rollers providing for easy movement of said horizontal beam to and from the position thereof beneath said vehicle without the requirement of elevating the vehicle relative to said horizontal beam.

* * * * *